United States Patent [19]

Caughie et al.

[11] Patent Number: 4,524,975

[45] Date of Patent: Jun. 25, 1985

[54] FOOTBALL GAME BOARD

[76] Inventors: Keith E. Caughie, 709 G St.; Kenneth L. Caughie, 4545 N. Petaluma Blvd, #7, both of Petaluma, Calif. 94952

[21] Appl. No.: 508,820

[22] Filed: Jun. 29, 1983

[51] Int. Cl.[3] ..... A63F 3/00

[52] U.S. Cl. ..... 273/247; 273/146

[58] Field of Search ..... 273/247, 146, 94

[56] References Cited

U.S. PATENT DOCUMENTS

| | | | |
|---|---|---|---|
| 1,562,866 | 11/1925 | Burgess | 273/146 X |
| 1,563,680 | 12/1925 | Zwirner | 273/146 X |
| 3,208,754 | 9/1965 | Seive | 273/146 |
| 3,806,120 | 4/1974 | Hess | 273/94 |
| 3,826,498 | 7/1974 | Monek | 273/146 X |
| 3,913,919 | 10/1975 | Carpenter | 273/274 |
| 4,211,410 | 7/1980 | Smith | 273/94 |

FOREIGN PATENT DOCUMENTS

| | | | |
|---|---|---|---|
| 505452 | 8/1930 | Fed. Rep. of Germany | 273/146 |
| 571182 | 8/1945 | United Kingdom | 273/247 |
| 883584 | 11/1961 | United Kingdom | 273/247 |
| 2060408 | 5/1981 | United Kingdom | 273/247 |

OTHER PUBLICATIONS

"All Star Football" Advertising Flier, Obtained by the PTO 3-1970.

*Primary Examiner*—Richard C. Pinkham
*Assistant Examiner*—Scott Brown
*Attorney, Agent, or Firm*—Melvin R. Stidham

[57] ABSTRACT

A football type game board utilizing specially designed, dice-like casting solids to represent the various plays used in the game of football. Each solid has a plurality of sides with markings denoting a particular outcome to that play. The number of sides and their markings are chosen to reflect real football game statistics. Also provided is a penalty card system organized into four categories, to produce a realistic penalty for particular types of plays, and a first down marker system with a down indicator sleeve.

11 Claims, 7 Drawing Figures

Fig. IA
Fig. IB
Fig. IC
Fig. ID
Fig. IE
Fig. IF
RUSHING PENALTY
PASSING PENALTY
KICKING PENALTY
RETURN PENALTY
Football Fever
KICKING
REFEREE / PENALTY
OFFENSE
OPTIONAL OFFENSE / RETURN
RECOVERY
DEFENSE

FOOTBALL GAME BOARD

BACKGROUND OF THE INVENTION

The popularity of the sport of football has resulted in the development of many board games designed to simulate the strategy and rules of the real game. Many of these board games use standard, six-sided dice to generate random plays and outcomes. This severely limits the range of possible plays and outcomes, and results in a gross oversimplification of the game. Other board games utilize data sheets or a "statistically weighted" card system to create a greater range of plays and outcomes. While these games do approach realism in terms of likelihood of outcome, they generally lack the excitement and spontaneity desired in a board game.

OBJECTS OF THE INVENTION

It is an object of this invention to provide a football game board that replicates the range of possible plays and the probability of their outcomes in the game of football.

It is a further object of this invention to provide a football game board that can be played without the use of comprehensive data sheets or cards to generate the plays and outcomes.

It is a further object of this invention to provide a football game board that instructs the players in the concepts and rules of the official game.

It is a further object of this invention to provide a football game board that is compact, portable and easily set up for play.

Other objects and advantages of this invention will become apparent from the description to follow, particularly when read in conjunction with the accompanying drawings.

SUMMARY OF THE INVENTION

The invention comprises a football type game board utilizing specially designed, dice-like casting solids to represent the various plays used in the game of football. Each solid or die has a plurality of sides or facets, with markings on each side denoting a particular outcome to that play. The number of sides and their markings are designed to reflect the range of possible outcomes and their probability of occurring, so that the throwing of the solids in a dice-like manner generates results similar to those which could be expected in a real football game.

Also provided is a penalty card system organized into four categories (rushing, passing, kicking and return), so that when a penalty is indicated by the casting solids, selection of a card from the appropriate category will produce a realistic penalty for that type of play.

Also provided is a first down marker system with a down indicator sleeve, for easy player reference.

BRIEF DESCRIPTION OF THE DRAWINGS

FIG. 1A illustrates the referee casting solid and penalty cards;

FIG. 1B illustrates the various kicking casting solids;

FIG. 1C illustrates the offensive casting solids;

FIG. 1D illustrates the optional offensive/return casting solid;

FIG. 1E illustrates the recovery casting solid; and

FIG. 1F illustrates the various defensive casting solids.

DETAILED DESCRIPTION OF A PREFERRED EMBODIMENT

Figure 1:
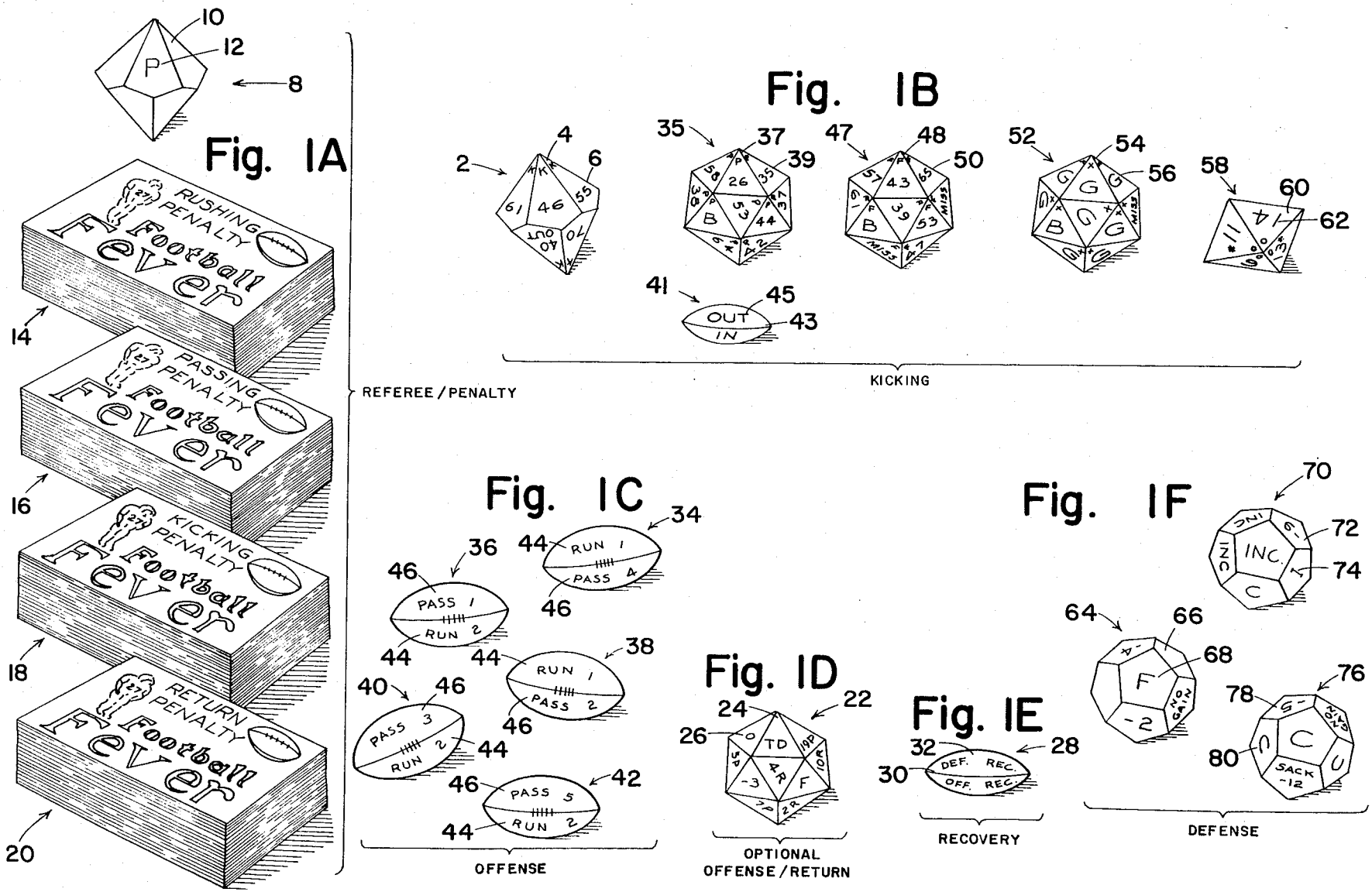
FIGS. 1A–1F are perspective views of the casting solids and penalty cards used in the football game board.

Referring now to FIGS. 1A through 1F with greater particularity, the football type game board of this invention includes special dice-like casting solids used to represent the types of plays in football. These solids are used in a logical order, following official football rules and replicating the action of a real game.

To initiate play, the players may toss a coin to determine which player will kick and which player will receive the ball. The kicking player then uses a kickoff random selection device, which may be in the form of a casting solid or die 2 (FIG. 1B) which has a plurality of sides or facets 4 each of which is marked with a different number 6, denoting the length of the kick. In addition, one of the sides is marked "out" for out of bounds. A decahedron, or ten-sided polyhedron, was chosen for the kickoff die to give a representative range of kickoff distances, e.g. from 40 to 70 yards, with an average of 57 yards, and one out of ten kickoffs going out of bounds. This is believed to be reflective of actual kickoff statistics, but a different number of sides on the casting solid and/or different yardage indicated on those sides could of course be chosen within the scope of this invention.

On every play, including the kickoff, the player also throws the referee die 8 (FIG. 1A), at least one side 10 of which is marked with some indicia 12, such as a "P" to indicate a penalty. A decahedron was also chosen for the referee die 8 so that, with only one side marked "P", the odds are that a penalty will be called in 10% of the plays, believed to be a realistic statistic.

When a penalty is called by throw of the referee die 8, the player must draw a card from one of four categories of penalty cards, 14, 16, 18 and 20 depending on the type of play during which the penalty was called; e.g. rushing, passing, kicking or return. These cards are variously labeled with typical penalties that occur for the given type of play, so that a realistic penalty is given. For example, the kicking play category includes cards that indicate an offensive fifteen yard penalty for clipping, a defensive fifteen yard penalty for piling on, and other kicking play related penalties. The passing play category, by contrast, includes cards that indicate an offensive ten yard penalty for an ineligible receiver down field, a defensive point-of-infraction/first down penalty for pass interference and so on.

The player receiving the kickoff may, at his option, choose to attempt a kick return. This is accomplished by the casting of the optional offensive/return casting solid 22 (FIG. 1D). The option to throw this offense/return die 22 is with the offensive player in possession of the football, i.e. the offensive player on scrimmage plays and the receiving player in a change of possession, as in returning a kick, recovering a fumble or a blocked kick, or intercepting a pass. An icosahedron, or twenty-sided polyhedron, was chosen for this optional die, and its sides 24 are marked with indicia 26 to reflect the outcome of the runback. For example, one side may show a fumble "F"; one side may show a touchdown "TD"; fourteen sides may show yardage gained over a range of, say, 1 to 30 yards; and the remaining sides may have indicia reflecting no gains or losses.

If, in throwing the optional offensive/return die 22, a fumble is generated, one player must additionally throw the recovery die 28 to determine which player recovers the fumble. In the preferred embodiment, the player responsible for the throwing of recovery die 28 is that player who first picks up said die after observing the indication of a fumble. As shown in FIG. 1E, the recovery die may be football shaped, with four sides 30 having indicia 32 thereon to denote the recovery. Two sides may be marked "DEF. REC." and two sides marked "OFF. REC." to give each player an even change of recovery, but this could also be varied. The player thus awarded the recovery of such a fumble may, at his option, attempt to advance the ball by casting the previously described optional offensive/return die 22.

When the kickoff is completed, play from scrimmage is initiated by the offensive player by casting offensive casting solids 34, 36, 38, 40 and 42. In FIG. 1C, these offensive casting solids 34, 36, 38, 40 and 42 are shown to be footballshaped with four sides 44 marked at 46 either "pass" or "run" and with a number representing a short gain. The offensive player calls "pass" or "run" as he throws the solids and only those numbers on the correct sides are totalled to show the net gain passing or running.

This results in a range of offensive outcomes of from 0 to 10 yards (average 3 to 4 yards) running, and from 0 to 21 yards (average 6 to 7 yards) passing, to be reflective of actual offensive statistics. The offensive player may, at his option, also throw the optional die 22 which may produce −5 to +30 yards to be added to the already generated offensive outcome, with a 5% change of a fumble, and a 5% chance of a touchdown.

As before, if a fumble is indicated, one player must then additionally throw the recovery casting solid 28, to determine who recovered the fumble, and the recovering player may, at his otion, attempt to advance the ball by casting the optional offensive/return die 22.

In an appropriate situation, the offensive player may throw the punting die 35, the sides 37 of which are marked with indicia 39 to indicate the success of the punt. The punting die 35 (FIG. 1B) may also be a twenty-sided polyhedron, with one side marked "B" to show the punt was blocked and the remaining sides marked with numbers reflective of a realistic punting performance, e.g. 20 to 65 yards, with an average of about 39 yards.

When using the punting die 35, the player must also cast an in bounds/out of bounds die 41, the sides 43 of which are marked with some indicia 45 denoting either an in bounds or out of bounds punt. The in bounds/out of bounds die 40 may be a four-sided, football shaped solid with two sides marked "IN" and two sides marked "OUT", giving a 50% chance of a kick going out of bounds.

If a blocked punt is indicated, and the punt did not go out of bounds, one player must then additionally throw the recovery die 28 to determine who recovered the ball, and then the player recovering the ball may attempt to advance it by throwing the optional offensive/return die 22. An unblocked, in bounds punt may be returned by the receiving player, by casting the offensive/return die 22.

The offensive player may wish to cast field goal die 47, the sides 48 of which are marked with some indicia 50 to denote the success or failure of the attempt. The field goal die 47 may also have twenty sides marked to provide a one-in-twenty chance of being blocked, a three-in-twenty chance of missing wide and the remaining sides calling for a range of field goal kick distances of, say, 35 to 65 yards.

In order for a particular field goal attempt to be successful, the yardage shown on indicia 50 must be equal to or greater than the distance from the line of scrimmage to the goal post (10 yards deep in the end zone). For example, an indication of a 35 yard kick would result in a successful field goal if such a kick had been attempted from the ten yard line, but the same kick would be unsuccessful if it had been attempted from the 30 yard line.

If a field goal attempt is blocked, one player must then cast the recovery die 28 to determine either an offensive or defensive recovery, and the player recovering the ball may attempt to advance the ball by casting the optional offensive/return die 22.

After scoring a touchdown, the offensive player may throw an extra point die 52, the sides 54 of which are marked with indicia 56 to denote either a successful or unsuccessful extra point attempt. As shown, the extra point die 52 may also be a twenty-sided polyhedron, with one side marked "B" for a blocked attempt, one side marked "miss" and the remaining sides marked "G" for good, giving a 90% chance of a successful extra point.

The offensive player may, in a kickoff situation, cast an onside kick die 58 the sides 60 each of which are marked with indicia 62 to indicate the distance of the kick, and whether it was recovered by the kicking player. For example, the onside kick die 58 may be an octahedron, or eight-sided polyhedron, with its sides marked to show the distance, e.g. 9 to 16 yards, and some of the sides, e.g. three of them, are also marked with an asterisk to denote recovery of the ball by the kicking player. The player recovering the onside kick may attempt to advance the ball by throwing the optional offense/return die 22.

The defensive player also participates in the game by use of certain defensive maneuvers. For example, a goal line/penetrating defense die 64 (FIG. 1F) may be thrown when such a defensive strategy is desired, its sides 66 being marked with some indicia 68 thereon, to denote some effect to the outcome as generated by the offensive casting solids 34 through 42. As shown, it may have twelve sides, with one side being marked "F" for fumble, one side marked "no gain" to negate any gain shown by the offensive solids, and five sides marked with short negative yardage to offset the offensive outcome. The remaining sides may be left blank to produce no effect on the offensive outcome.

As before, if a fumble is indicated, one player must then additionally cast the recovery die 28, described earlier, to determine who recovered, and the player recovering such a fumble may, at his option, attempt to advance the ball by throwing the offensive/return die 22.

In another situation, the defensive player may cast a nickle defense die 70, the sides 72 of which are marked with indicia 74 to indicate some effect to the offensive outcome as generated by the offensive casting solids. The nickle defense casting solid 70 may also have twelve sides, one marked "I" to denote an interception, one with negative yardage, say −9, to denote a sacking of the quarterback, six sides "Inc" for incomplete and the others marked "C" to show pass completion. If an interception is indicated, the defensive player may, at his option, attempt to advance the ball by throwing the optional offensive/return die 22.

Alternatively, the defensive player may cast a blitz/red dog defense die 76 the sides 78 of which are marked with indicia 80 to indicate its effect on the offensive outcome. The blitz/red dog defense die 76 may also have twelve sides, two marked with negative yardage, e.g. −12 and −6, to denote quarterback sacks, one marked "no gain," one marked "Inc" for incomplete and the others marked "C" for complete.

Figure 2:
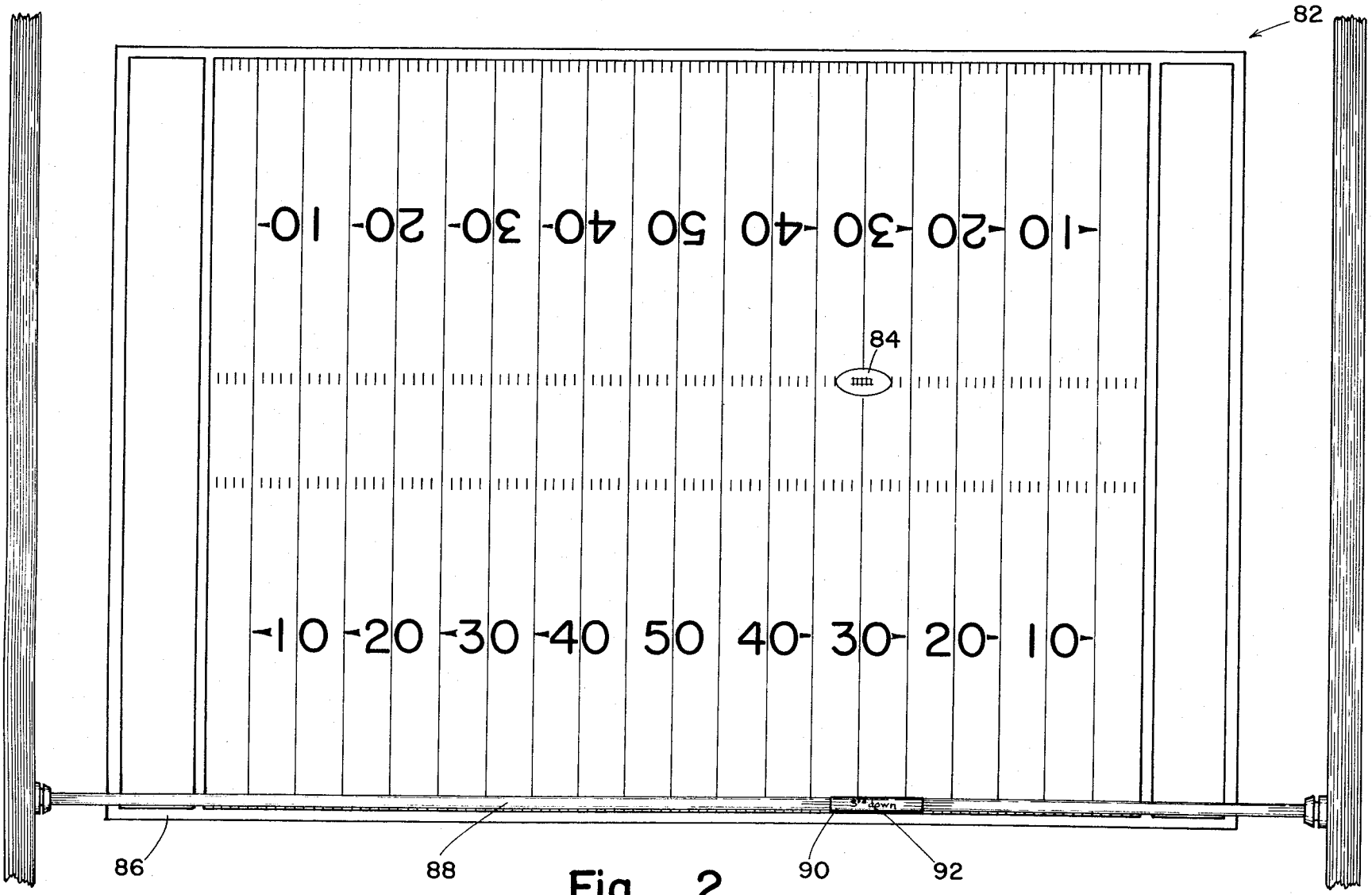
FIG. 2 is a top view of the game board and first down marker system used in the football game board.

Referring now to FIG. 2 with greater particularity, a game board 82 is provided to represent a football field. Playing piece 84 is moved up and down the field according to the outcomes generated by the casting solids. The first down market system 86 utilizes a sideline-mounted shaft 88 with a slidable sleeve 90 "ten yards" in length to indicate the remaining yardage required for a first down. Sleeve 90 is further marked into four sections 92 which are labelled "first down", "second down", "third down" and "fourth down", and are used to indicate the down by rotating the sleeve about the shaft axis.

While this invention has been described in conjunction with a preferred embodiment thereof, it is obvious that modifications and changes therein may be made by those skilled in the art to which it pertains without departing from the spirit and scope of this invention, as defined by the claims appended hereto.

What is claimed as invention is:

1. A football type board game comprising:

a game board marked to simulate a football field with goal posts at each end;

a game piece representing a football to be moved along the game board;

a referee random selection means to be utilized on every play;

said referee random selection means having at least eight facets, one of said facets bearing indicia thereon denoting a penalty, other facets being unmarked to indicate a play unaffected by an official's call; and a plurality of play random selection means, a selected one of said play random selection means to be utilized on each play;

said play random selection means comprising:

a plurality of multi-sided scrimmage dice, the sides of each bearing indicia thereon denoting yardage;

some of said sides bearing indicia thereon denoting rushing yards, the other of said sides bearing indicia thereon denoting passing yards;

said rushing yards displayed to be totalled to determine yards gained when a rushing play is called prior to display, and said passing yards displayed to be totalled to determine yards gained when a passing play is called prior to display;

and a plurality of kicking random selective devices to be used selectively in kicking situations;

said game further including:

a set of rushing penalty cards to be drawn from on a rushing play from scrimmage upon random selection of a penalty facet by use of said referee random selection means;

a set of passing penalty cards to be drawn from on a passing play from scrimmage upon random selection of a penalty facet by use of said referee random selection means; and a set of kicking penalty cards to be drawn from on a kicking play upon selection of a penalty facet by use of said referee random selection means.

2. The football board game described in claim 1 including:

an optional offensive/return die having at least eighteen sides, one of said sides bearing indicia thereon denoting a fumble, one of said sides having indicia thereon denoting a touchdown, and at least some of said sides bearing indicia thereon denoting yardage gained.

3. The football type board game described in claim 2 including:

a recovery die to be cast when a fumble is indicated by said optional offensive/return die comprising:

a recovery die having at least two sides, at least $\frac{1}{4}$ of said sides bearing indicia thereon denoting that said fumble resulted in a defensive recovery, and at least $\frac{1}{4}$ of said sides bearing indicia thereon denoting that said fumble resulted in an offensive recovery.

4. The football type board game described in claim 2 including:

a set of return penalty cards to be drawn from on a return play upon random selection of a penalty facet by use of said referee random selection means.

5. The football type board game described in claim 1 including:

a defensive die having at least ten sides, at least some of said sides bearing indicia thereon denoting some reduction of yards gained according to the scrimmage dice.

6. The football type board game described in claim 1, wherein said kicking random selection devices include:

a kickoff casting solid having at least eight sides, one of said sides indicating an out of bounds kickoff and at least some of said sides bearing indicia thereon denoting a kickoff of some designated yardage.

7. The football type board game described in claim 1 wherein said kicking random selection devices include:

a punting casting solid having at least eighteen sides, one of said sides bearing indicia thereon denoting a blocked punt and other sides indicating a punt of some designated yardage.

8. The football type game board described in claim 7 including:

an in bounds/out of bounds casting solid having at least two sides, at last $\frac{1}{4}$ of said sides bearing indicia thereon denoting an in bounds punt, and at least $\frac{1}{4}$ of said sides bearing indicia thereon denoting an out of bounds punt.

9. The football type game board described in claim 1 wherein said kicking random selection devices include:

a field goal casting solid having at least eighteen sides, at least some of said sides bearing indicia thereon denoting a field goal kick of some designated yardage to be compared with yardage from the position of the ball to the opponent's goal posts.

10. The football type board game described in claim 1 wherein said kicking random selection devices include:

an extra point casting solid having at least eighteen sides, at least one of said sides bearing indicia thereon denoting a failed extra point attempt.

11. The football type board game described in claim 1 wherein said kicking random selection devices include:

an onside kick casting solid having at least eight sides, at least three of said sides bearing indicia thereon denoting recovery by the kicking side.

* * * * *